US007900619B1

(12) United States Patent
Palmer et al.

(10) Patent No.: US 7,900,619 B1
(45) Date of Patent: Mar. 8, 2011

(54) SYSTEM FOR LUMINESCING AND PROPELLING A PROJECTILE

(75) Inventors: William R. Palmer, Rescue, CA (US); Stephen L. Palmer, Cameron Park, CA (US); Robert N. Palmer, Hollywood, CA (US)

(73) Assignee: Sierra Innotek, Inc., Cameron Park, CA (US)

( * ) Notice: Subject to any disclaimer, the term of this patent is extended or adjusted under 35 U.S.C. 154(b) by 475 days.

(21) Appl. No.: 12/012,956

(22) Filed: Feb. 6, 2008

Related U.S. Application Data

(60) Provisional application No. 60/900,260, filed on Feb. 7, 2007.

(51) Int. Cl.
*F41B 7/08* (2006.01)

(52) U.S. Cl. ..... 124/16; 124/73; 473/570; 473/578

(58) Field of Classification Search ..... 473/570, 473/578; 124/1, 73, 74, 16, 27; 446/473
See application file for complete search history.

(56) References Cited

U.S. PATENT DOCUMENTS

| | | | | |
|---|---|---|---|---|
| 5,032,098 | A * | 7/1991 | Balogh et al. | 446/47 |
| 5,102,131 | A * | 4/1992 | Remington | 473/570 |
| 5,134,552 | A * | 7/1992 | Call et al. | 362/203 |
| 5,186,458 | A * | 2/1993 | Redondo | 473/570 |
| 5,388,825 | A * | 2/1995 | Myers et al. | 473/570 |
| 5,415,151 | A * | 5/1995 | Fusi et al. | 124/56 |
| 5,490,047 | A * | 2/1996 | O'Rourke et al. | 473/570 |
| 5,564,964 | A * | 10/1996 | Chin-Chien | 446/406 |
| 5,762,058 | A * | 6/1998 | Cheng et al. | 124/56 |
| 5,779,575 | A * | 7/1998 | Hsieh | 473/570 |
| 6,048,280 | A * | 4/2000 | Palmer et al. | 473/416 |
| 6,123,631 | A * | 9/2000 | Ginder | 473/570 |
| 6,390,642 | B1 * | 5/2002 | Simonton | 362/203 |
| 6,464,602 | B1 * | 10/2002 | Rottger | 473/571 |
| 6,648,726 | B2 * | 11/2003 | Hornsby et al. | 446/483 |
| 6,736,742 | B2 * | 5/2004 | Price et al. | 473/570 |
| 7,108,576 | B2 * | 9/2006 | LaPointe | 446/47 |

* cited by examiner

*Primary Examiner* — John Ricci
(74) *Attorney, Agent, or Firm* — Thomas R. Lampe

(57) ABSTRACT

A projectile having light emitting structure and a rechargeable power source is launched by projectile launching apparatus such as a gun. The projectile launching apparatus charges the rechargeable power source and when the projectile is propelled a visual display is produced by the lighted propelled projectile.

22 Claims, 5 Drawing Sheets

SYSTEM FOR LUMINESCING AND PROPELLING A PROJECTILE

This application is based on and claims the benefit of U.S. Provisional Patent Application Ser. No. 60/900,260, filed Feb. 7, 2007.

TECHNICAL FIELD

This invention relates to a method and apparatus for illuminating and propelling a projectile. The preferred embodiment disclosed herein has particular application to toy guns wherein a projectile simulating a tracer round is fired by the user. However, the invention does have application to other arrangements wherein it is desired to fire projectiles which emit a light, an example being a signal gun.

BACKGROUND OF THE INVENTION

Many toys exist which simulate in some manner the operation of fire arms. It is well known, for example, to propel darts, balls and other projectiles from gun-like devices. The propulsion systems utilized in such devices vary widely and can include springs, pressurized gas systems and so forth. Quite a number of prior art designs for simulated weapons incorporate electrical or pyrotechnic means for providing lighting or sound effects. These audio and visual displays are sometimes employed in conjunction with toy weapons which propel a projectile of some type. In other cases, the lighting and sound effects are incorporated in simulated weapons which do not in fact propel a projectile of any type.

The preferred form of apparatus disclosed herein relates to a toy gun, cannon, rocket launcher or other projectile launching means which utilizes one or more illuminated projectiles to simulate tracer rounds. Typically, tracer ammunition utilized in actual weaponry contains a small pyrotechnic charge positioned in a hollow portion of a projectile. When the propelling charge is burned, the tracer charge is ignited and burns brightly as the projectile proceeds toward the intended target. Due to the photochemical persistence of the human eye, this traveling light source is perceived as an arc of light. When tracer ammunition is used at night, the trajectory of the projectile is easily monitored by this display.

The following United States patents disclose devices believed to be representative of the current state of the prior art in this field: U.S. Pat. No. 7,108,576, U.S. Pat. No. 6,648,726, U.S. Pat. No. 5,415,151, U.S. Pat. No. 5,032,098, U.S. Pat. No. 5,102,131, U.S. Pat. No. 5,388,825, U.S. Pat. No. 5,490,047, U.S. Pat. No. 5,186,458, U.S. Pat. No. 5,564,964, U.S. Pat. No. 5,779,575 and U.S. Pat. No. 6,464,602.

DISCLOSURE OF INVENTION

With the present invention simulation of tracer bullets or other projectiles is accomplished without the use of a burning projectile component. The structural elements and method steps utilized to accomplish the intended result are relatively simple, inexpensive and address the concerns of safety. The invention utilizes lighted projectiles powered by rechargeable power sources which are rapidly charged by a launcher to provide a toy that is not only inherently safe but highly interesting. The brilliant glow of the projectiles remains visible for a considerable length of time, making it a relatively easy matter to locate the projectiles in the dark after they have been projected. Light produced by the projectiles may be of any color desired. The projectile may even be made to emit infrared or ultraviolet light, viewable only by special equipment as may be desired for covert operation.

Projectile propulsion apparatus of the present invention is employed to charge and propel a projectile, said projectile including light emitting structure and a rechargeable power source.

Prior to or during launch the rechargeable power source of the projectile is charged by the projectile propulsion apparatus whereby the projectile will emit light at least after being launched from the apparatus.

The light emitting means includes at least one LED, incandescent lamp, electroluminescent device or other electric means for illuminating the projectile. The apparatus additionally comprises an electrical energy source for charging the rechargeable power source of the projectile.

Other features, advantages and objects of the present invention will become apparent with reference to the following description and accompanying drawings.

MODES FOR CARRYING OUT THE INVENTION

Figure 1:
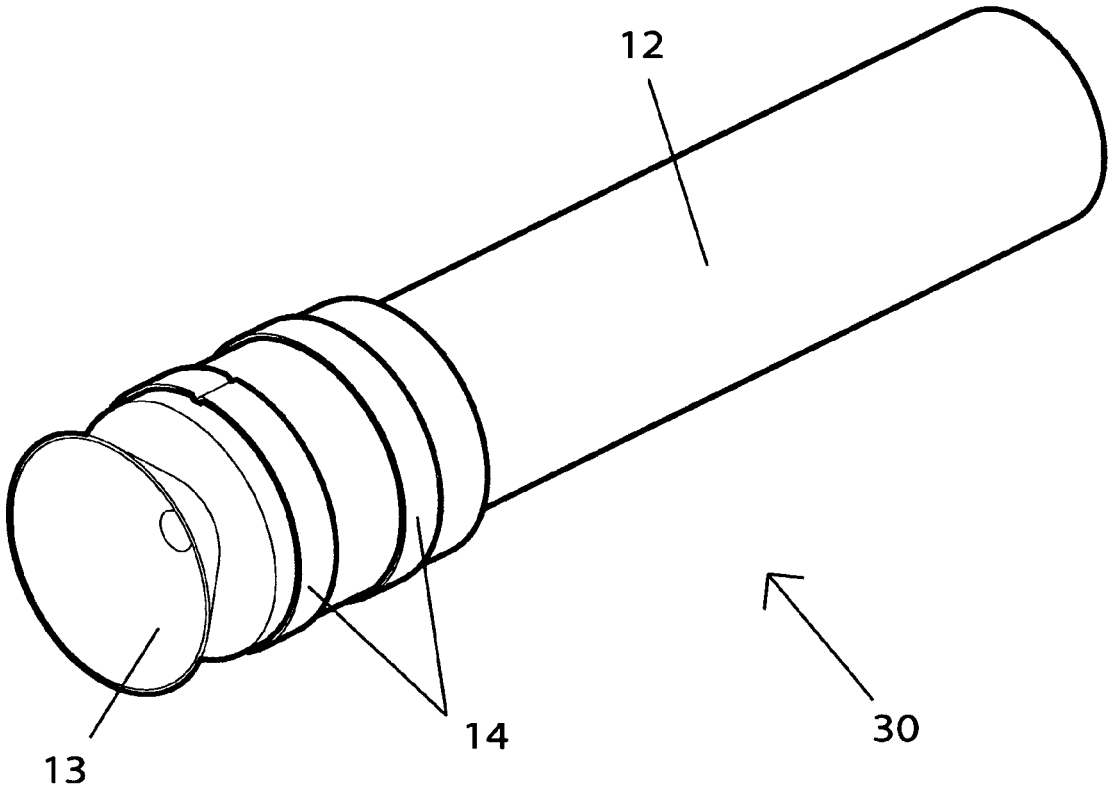
FIG. 1 is a view of one embodiment of projectile constructed in accordance with the teachings of the present invention employing electrodes to facilitate charging.
Figure 2A:
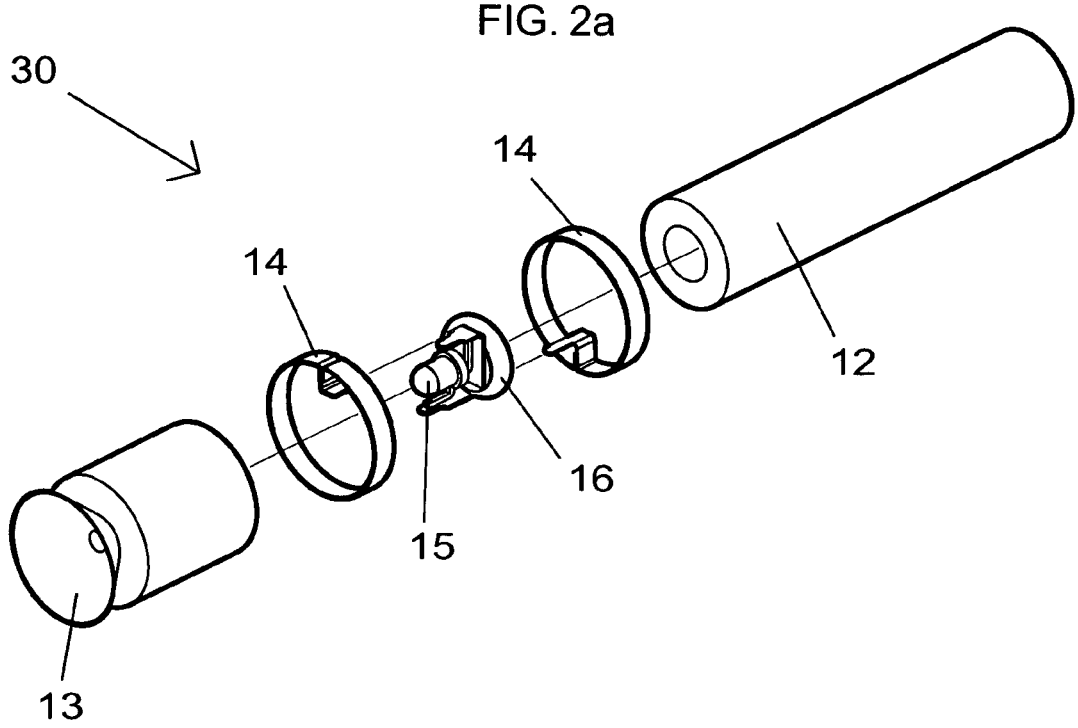
FIG. 2*a* is an exploded view of the projectile embodiment shown in FIG. 1 illustrating illumination structure, a rechargeable power source and charging electrodes.
Figure 3:
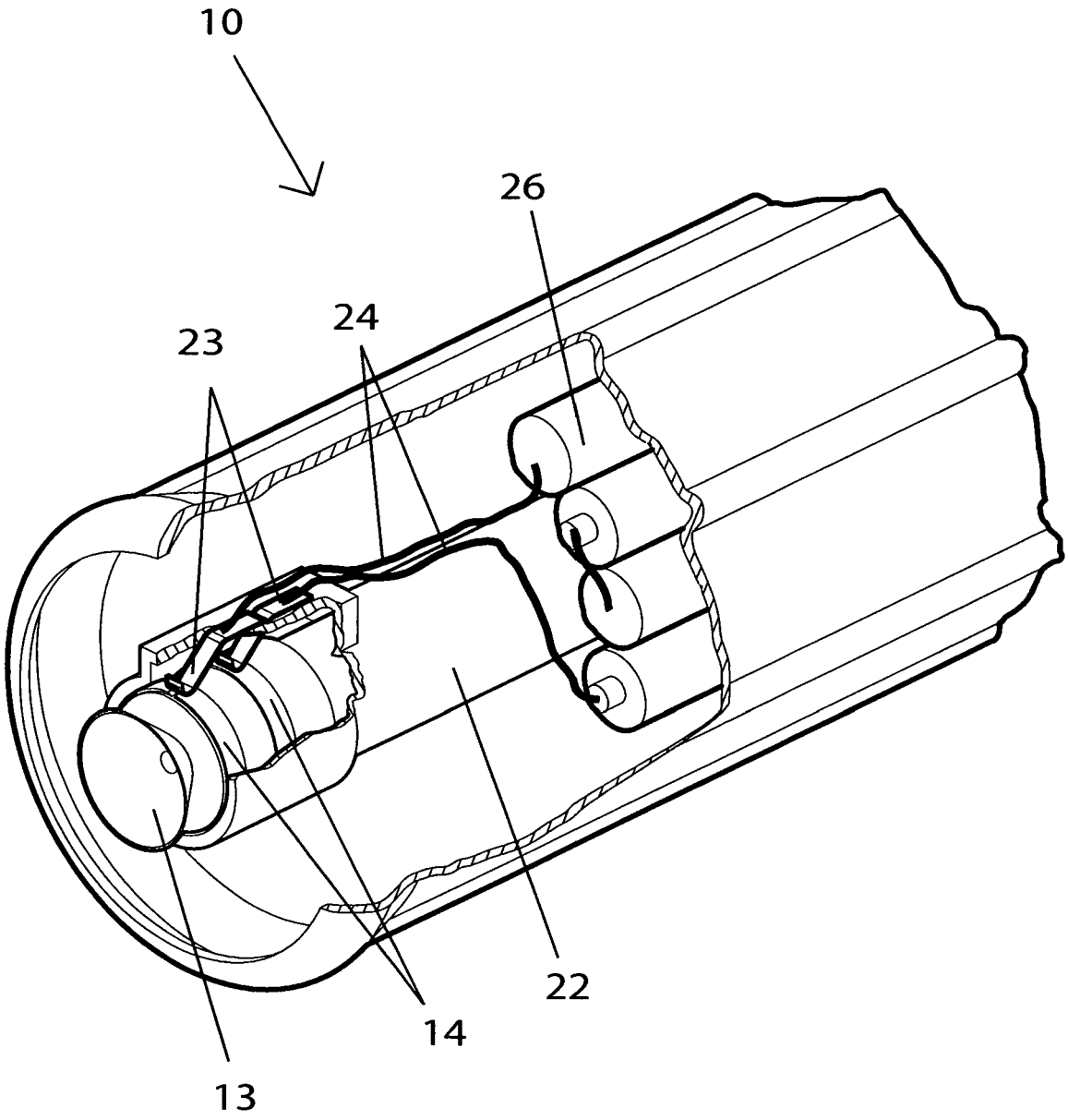
FIG. 3 is an enlarged, cutaway detail, perspective section view illustrating the barrel of a gun with the projectile of FIG. 1 disposed therein and showing the position of charging contacts of the gun operatively associated with batteries of the gun.

Referring now to FIGS. 1, 2*a* and 3 of the drawings, a system constructed in accordance with the teachings of the present invention for luminescing and propelling a projectile includes a projectile 30 and projectile propulsion apparatus in the form of a toy gun including a launch tube 22 having an open end and a barrel interior.

Situated within the launch tube is projectile 30. Referring now to FIG. 1, projectile 30 includes a projectile body 12 constructed of a soft material such as plastic foam. Referring now to FIG. 2*a*, it can be seen that projectile 30 also comprises light emitting structure 15 and rechargeable power source 16. Rechargeable power source 16 is electrically connected to charging electrodes 14 so that power from the projectile launcher may be transferred to rechargeable power source 16 and thereby power light emitting structure 15.

Light emitting structure 15 may comprise an incandescent lamp, an LED, an electroluminescent device or any other suitable electrically powered light emitting means but is preferably an LED. An LED provides a compact, efficient, high intensity source of light which is well suited to the operation of the present invention.

Rechargeable power source 16 may comprise a battery such as a nickel-cadnium battery, a lithium battery, a capacitor, or any other suitable electric energy storage means. Rechargeable power source 16 is preferably a supercapacitor. A supercapacitor or ultracapacitor is an electrochemical capacitor that has an unusually high energy density when compared to common capacitors. Such capacitors are well suited to the instant invention in that they are very small with respect to the energy that they can store, are relatively light in weight and can be charged extremely rapidly without damage to the device. It has been found that a supercapacitor with a value of 0.6 Farad and a voltage rating of 3 Volts can, after charging, power an LED brilliantly for many minutes. Additionally, supercapacitors of this type have recently become common components in cell phones and other portable electronic devices so they are readily available and very inexpensive. One manufacturer of suitable supercapacitors is Kyocera Corporation, Kyoto, Japan.

Light emitting structure 15 may be positioned in any portion of projectile body 12 as may be desired. Additionally, light emitting structure 15 may be oriented in any manner as may be desired. Further, light emitting structure 15 may comprise multiple light emitters such as a plurality of LEDs or other light emitting means as may be desired in any combination of colors as may be desired. Further, the light emitting structure may be caused to flash or pulse in any sequence or combination as may be desired.

Figure 5:
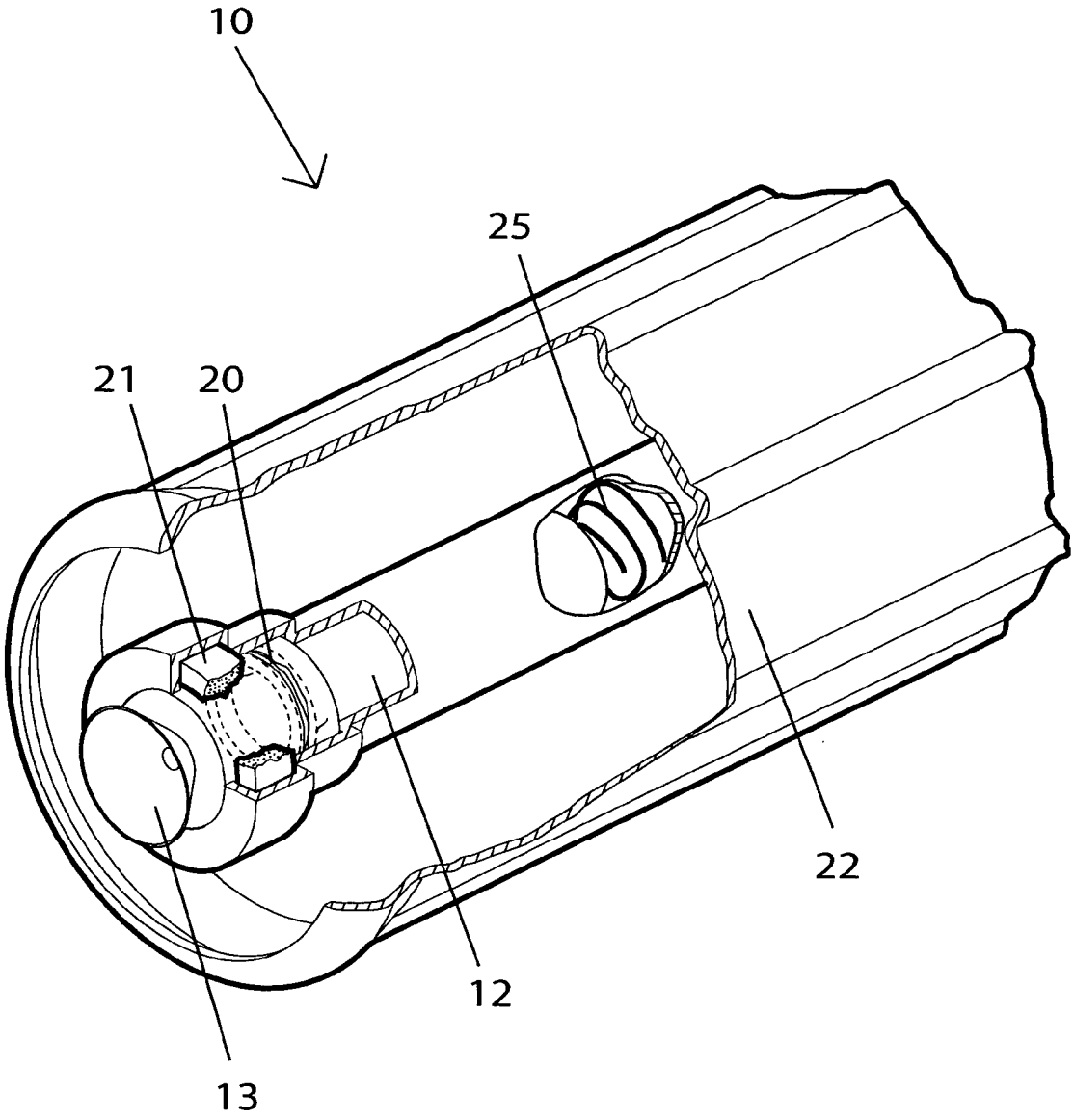
FIG. 5 is an enlarged, cutaway detail, perspective section view illustrating the barrel of a gun accommodating the third embodiment of projectile and showing the relationship between an inductive coupler coil and an inductive coupling magnet.

The exact means of propulsion of the projectile is not important, though typically, springs or gas pressure may be employed for this purpose. The embodiment shown in FIG. 5 shows use of a spring 25 to provide propulsion. Fundamental to the operation of the instant invention is that the projectile includes a rechargeable power source and interconnected light emitting structure. The rechargeable power source may be charged from a separate charging station in which power is transferred from a power source external to the projectile to the rechargeable power source integral to the projectile. Preferably, this charging station is integral to the launcher so that the rechargeable power source may be conveniently charged until the instant that it is propelled from the launcher. This launcher may be in the form of a gun, cannon, rocket gantry or any other desired form. The source of power in the charging station may comprise a battery 26, for example a number of cells such as those referred to as "AA" size. The launcher may be outfitted with light or sound generation means as may be desired for decoration or to indicate the status of the projectile being charged. For example, a siren sound of increasing pitch could indicate the relative state of charge of the rechargeable power source integral to the projectile. Since the power source integral to the projectile is rechargeable, it is not necessary to include a switch to turn off the light emitting means in the projectile since it will be instantly recharged to full power the next time it is connected to the charging station.

A convenient means of coupling electric energy to rechargeable power source 16 from the launcher is by means of charging projectile launching apparatus electrodes 14 as illustrated in FIG. 1. Charging electrodes 14 may be in any desirable form such as pins, rings or probes, and may be positioned coaxially if desired. One convenient embodiment for charging electrodes takes the form of rings which surround the external diameter of the projectile. An arrangement such as this permits the projectile to be inserted into the launching apparatus without concern with respect to rotational orientation. FIG. 2*a* shows projectile 30 and possible relative positioning of charging electrodes 14, light emitting structure 15, and rechargeable power source 16.

Figure 2B:
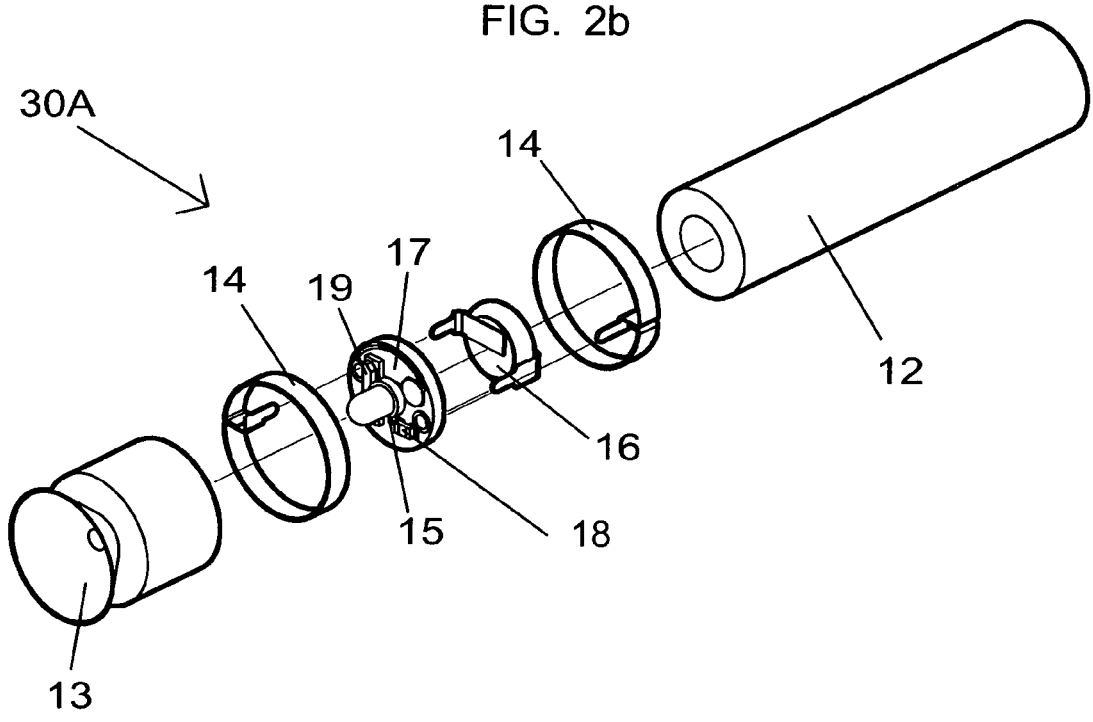
FIG. 2*b* is an exploded view of a second embodiment of projectile of the instant invention showing illumination structure, a rechargeable power source, charging electrodes and a control circuit.

FIG. 2*b* shows an embodiment of projectile 30A with light emitting structure which is incorporated with a control circuit 18. Said circuit may be constructed on a circuit board 17 and may employ a means such as a microchip to control the operation of light emitting structure 15. Additionally, acceleration sensor 19 may be employed to trigger an action of light emitting structure 15, for example, a bright flash upon impact of the projectile or other desired visual or sound effect which is related to a change in acceleration of projectile 30A. Acceleration sensor 19 may comprise any of the well-known acceleration sensors or switches such as, but not limited to, piezoelectric sensors, magnetic sensors, "gravity switches" or any other suitable sensor or switch. Said sensor or switch may interact directly with light emitting structure 15 or provide a signal to control circuit 18 to achieve the desired effect.

Among other functions, control circuit 18 may cause light emitting structure 15 to flash, fade, change color or provide any other desired optical effect. Additionally, the light emitting structure may be controlled in such a manner that a signal or other telemetry may be transmitted from the projectile which may be received by a remote receiver, which receiver may be for example, coupled with the projectile launcher. Such telemetry could relay the status of the projectile, or be used to transmit data collected by the projectile. Further, an audio transducer such as a speaker or buzzer may be employed as part of the system integral to the projectile so that a sound effect can be generated by the projectile. Said transducer could derive any electrical power from the aforementioned rechargeable power source. It is anticipated by the instant invention that the control circuit previously described might be of a programmable nature whereby the circuit receives program instructions from the launcher prior to, during or after charging of the rechargeable power source. Said program instructions could be transferred via the same charging electrodes as are used to charge the rechargeable power source. Additional electrodes or any form of wireless technology could also be employed to provide these instructions.

Mating projectile launching apparatus electrodes on the launcher are designed so that their mechanical contact, while sufficient to transfer electrical energy reliably, does not significantly reduce the launch velocity of the projectile. The mating electrodes on the launcher may be designed to automatically retract from the projectile immediately before the projectile is propelled from the launcher so that they do not drag on the projectile or may be otherwise configured so as to provide minimal drag on the projectile. FIG. 3 illustrates one possible embodiment for projectile launching apparatus electrodes 23. Electrical conductors 24 connect coupling electrodes 23 to battery 26 of the launcher.

Figure 4:
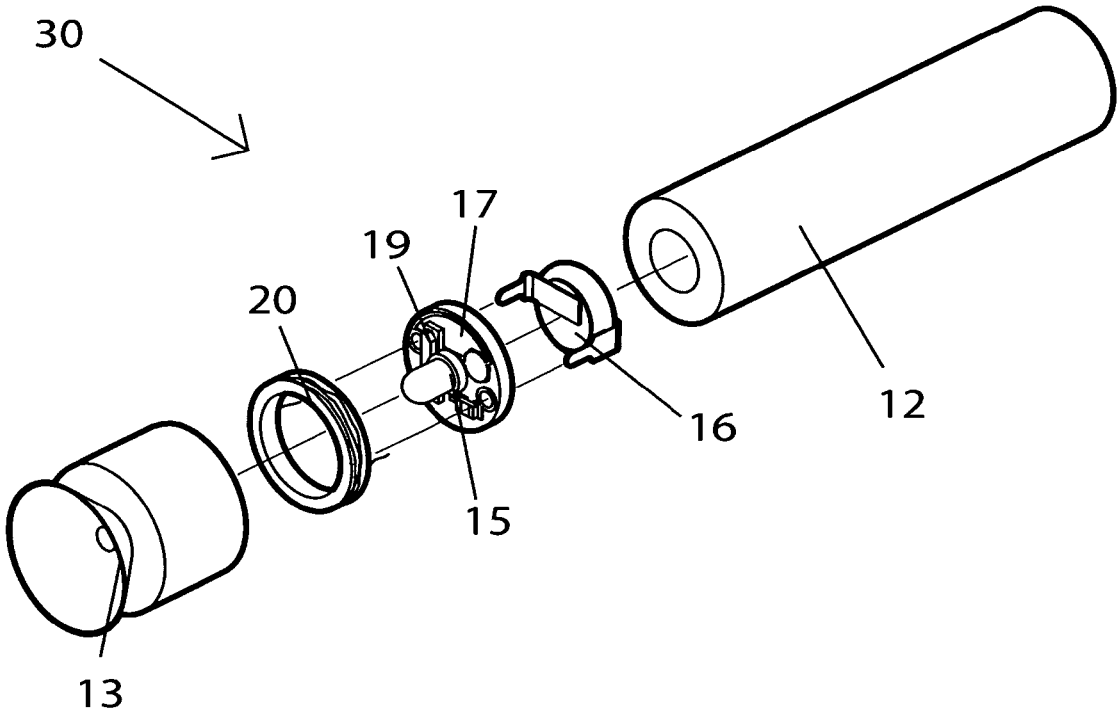
FIG. 4 is an exploded view of a third embodiment of projectile of the instant invention showing illumination structure, a rechargeable power source, an inductive coupler coil and a control circuit.

Another method of transferring electrical energy to the rechargeable power source is by means of electromagnetic induction. Since a conductor moving through a magnetic field generates a voltage potential, such a system may be employed to advantage. FIG. 4 shows a projectile 30B with integral inductive coupler coil 20. Now, referring to FIG. 5, as projectile 30B is propelled through (or past) inductive coupling magnet 21, a voltage is generated in inductive coupler coil 20. This voltage may be rectified and used to charge rechargeable power source 16. Such a system would not require that the launcher comprise a battery or similar power source since necessary power to charge rechargeable power source 16 would be derived from conversion of mechanical energy such as that associated with a spring or air pressure to electrical energy when the projectile was launched.

The invention claimed is:

1. In combination:

projectile launching apparatus and a projectile positionable in said projectile launching apparatus, said projectile including light emitting structure and a rechargeable power source operatively associated with said light emitting structure, said projectile launching apparatus including a source of electrical energy operable to charge said rechargeable power source and cause said light emitting structure to emit light at least after launch of said projectile by said projectile launching apparatus.

2. The combination according to claim 1 wherein said projectile launching apparatus includes a launch tube for receiving said projectile prior to launching of said projectile.

3. The combination according to claim 1 wherein said projectile includes projectile electrodes electrically connected to said rechargeable power source and wherein said projectile launching apparatus includes projectile launching apparatus electrodes electrically connected to said source of electrical energy, relative movement between said projectile and said projectile launching apparatus bringing said projectile electrodes into operative association with said projectile launching apparatus electrodes whereby said rechargeable power source is electrically charged by said source of electrical energy.

4. The combination according to claim 3 wherein said source of electrical energy comprises at least one battery and wherein said projectile electrodes and said projectile launching apparatus electrodes are brought into engagement during launching of said projectile.

5. The combination according to claim 3 wherein said projectile electrodes are in the form of rings.

6. The combination according to claim 1 herein said projectile additionally includes an inductive coupler coil electrically connected to said rechargeable power source, said source of electrical energy comprising an inductive coupling magnet, relative movement between said projectile and said projectile launching apparatus during launch generating a voltage in said inductive coupler coil by said inductive coupling magnet to charge said rechargeable power source.

7. The combination according to claim 1 wherein said rechargeable power source comprises at least one battery.

8. The combination according to claim 1 wherein said rechargeable power source comprises at least one capacitor.

9. The combination according to claim 1 wherein said light emitting structure includes at least one LED.

10. The combination according to claim 1 wherein said projectile additionally includes control structure operatively connected to said light emitting structure for controlling operation of said light emitting structure.

11. The combination according to claim 1 including structure operatively associated with said projectile and said projectile launching apparatus to cause said light emitting structure to emit light due to electrical induction.

12. A projectile for launching from projectile launching apparatus having a source of electrical energy, said projectile including light emitting structure and a rechargeable power source operatively associated with said light emitting structure, said rechargeable power source for receiving electrical energy from the source of electrical energy and cause said light emitting structure to emit light at least after launching of said projectile by said projectile launching apparatus.

13. The projectile according to claim 12 additionally including projectile electrodes electrically connected to said rechargeable power source.

14. The projectile according to claim 12 wherein said projectile includes an inductive coupler coil electrically connected to said rechargeable power source.

15. The projectile according to claim 12 wherein said rechargeable power source comprises at least one battery.

16. The projectile according to claim 12 wherein said rechargeable power source comprises at least one capacitor.

17. The projectile according to claim 12 wherein said light emitting structure includes at least one LED.

18. The projectile according to claim 12 wherein said projectile electrodes are in the form of rings.

19. The projectile according to claim 12 additionally including control structure operatively connected to said light emitting structure for controlling operation of said light emitting structure.

20. A method of illuminating a projectile launched from projectile launching apparatus, said method comprising the steps of:

providing said projectile with light emitting structure and a rechargeable power source for powering said light emitting structure;

providing said projectile launching apparatus with a source of electrical energy;

launching said projectile from said projectile launching apparatus;

prior to or during the step of launching said projectile from said projectile launching apparatus, employing said source of electrical energy to charge said rechargeable power source; and employing said charged rechargeable power source to light said light emitting structure at least after launching of said projectile by said projectile launching apparatus.

21. The method according to claim 20 wherein electrodes on said projectile are brought into contact with electrodes on said projectile launching apparatus to provide an electrical connection between said rechargeable battery source and said source of electrical energy.

22. The method according to claim 20 wherein said rechargeable power source is charged by electromagnetic induction.

* * * * *